US012435957B2

(12) United States Patent
Lee

(10) Patent No.: US 12,435,957 B2
(45) Date of Patent: Oct. 7, 2025

(54) DART GAME DEVICE

(71) Applicant: Phoenixdarts Co., Ltd., Seoul (KR)

(72) Inventor: Seung Yoon Lee, Seoul (KR)

(73) Assignee: Phoenixdarts Co., Ltd., Seoul (KR)

( * ) Notice: Subject to any disclaimer, the term of this patent is extended or adjusted under 35 U.S.C. 154(b) by 436 days.

(21) Appl. No.: 17/769,310

(22) PCT Filed: Aug. 10, 2020

(86) PCT No.: PCT/KR2020/010542
§ 371 (c)(1),
(2) Date: Apr. 14, 2022

(87) PCT Pub. No.: WO2021/075684
PCT Pub. Date: Apr. 22, 2021

(65) Prior Publication Data

US 2024/0159504 A1 May 16, 2024

(30) Foreign Application Priority Data

Oct. 18, 2019 (KR) ..... 10-2019-0129865

(51) Int. Cl.

| | |
|---|---|
| ***F41J 3/00*** | (2006.01) |
| ***F41J 3/02*** | (2006.01) |
| ***F41J 5/10*** | (2006.01) |
| ***F41J 5/14*** | (2006.01) |

(52) U.S. Cl.
CPC ..... *F41J 3/0019* (2013.01); *F41J 3/02* (2013.01); *F41J 5/10* (2013.01); *F41J 5/14* (2013.01)

(58) Field of Classification Search
CPC ..... F41J 3/0019; F41J 3/02; F41J 3/00; F41J 5/10; F41J 5/14
See application file for complete search history.

(56) References Cited

U.S. PATENT DOCUMENTS

| | | | |
|---|---|---|---|
| 4,241,777 | A | 12/1980 | Wenger et al. |
| 4,881,744 | A | 11/1989 | Hansen |
| 5,004,247 | A | 4/1991 | Menke |
| 5,211,405 | A | 5/1993 | Shelton et al. |
| 8,113,930 | B1 | 2/2012 | Coats |
| 10,762,800 | B2 | 9/2020 | Hong |
| 2003/0096658 | A1 | 5/2003 | Elliott |

(Continued)

FOREIGN PATENT DOCUMENTS

| | | | |
|---|---|---|---|
| CN | 102107084 | A | 6/2011 |
| CN | 106999763 | A | 8/2017 |

(Continued)

OTHER PUBLICATIONS

Office Action for Japanese Patent Application No. 2022-522871 dated May 9, 2023; 4 pgs.

(Continued)

*Primary Examiner* — Raleigh W Chiu
(74) *Attorney, Agent, or Firm* — Umberg Zipser LLP; Ryan Dean

(57) ABSTRACT

Provided is a dart game apparatus including: a body part in which a dart target is installed on a front surface; a support unit including a coupling unit coupled to an upper side of the body part and an extension unit formed to extend toward a front surface of the coupling unit; and a lid unit rotatably coupled to the support unit through at least one hinge.

10 Claims, 8 Drawing Sheets

(56) References Cited

U.S. PATENT DOCUMENTS

| | | | | |
|---|---|---|---|---|
| 2006/0287112 | A1* | 12/2006 | Mallory | G07F 17/32 463/46 |
| 2017/0189810 | A1 | 7/2017 | Hong | |
| 2017/0326444 | A1 | 11/2017 | Hong | |
| 2020/0038743 | A1* | 2/2020 | Chung | A63F 9/02 |

FOREIGN PATENT DOCUMENTS

| | | | | |
|---|---|---|---|---|
| CN | 109937336 | A | 6/2019 | |
| DE | 4301955 | C1 | 3/1994 | |
| DE | 29803062 | U1 | 4/1998 | |
| GB | 2459511 | A * | 10/2009 | A63B 71/04 |
| JP | 5433321 | | 3/1979 | |
| JP | 5558749 | B2 | 7/2014 | |
| KR | 2019990034812 | U | 9/1999 | |
| KR | 1020050017344 | A | 2/2005 | |
| KR | 101032367 | B1 | 5/2011 | |
| KR | 101815119 | B1 | 1/2018 | |
| KR | 101897116 | B1 | 9/2018 | |
| KR | 1020190079009 | A | 7/2019 | |
| KR | 102230489 | B1 * | 3/2021 | |
| TW | 201735974 | A | 10/2017 | |
| TW | 201916914 | A | 5/2019 | |

OTHER PUBLICATIONS

China Patent Office, Office Action, Sep. 15, 2023.

Dershang, Premium Door Type Electronic Dart Machine (Xiaodou Sprout Dart Net #F01), available at https://www.uten.com.tw/item/show?21109192372490.

PCT International Search Report and Written Opinion; International Application No. PCT/KR2020/010542; International Filing Date Aug. 10, 2020; 6 pages.

Intellectual Property Office of Singapore, Search Report, Dec. 8, 2023.

* cited by examiner

DART GAME DEVICE

CROSS-REFERENCE TO RELATED APPLICATIONS

This application claims priority to and the benefit of Korean Patent Application No. 10-2019-0129865 filed in the Korean Intellectual Property Office on Oct. 18, 2019, the entire contents of which are incorporated herein by reference.

TECHNICAL FIELD

The present disclosure relates to a dart game apparatus.

BACKGROUND ART

In general, a dart refers to a 'small arrow' and is a game that makes marks by throwing an arrow-shaped dart to a centrifugal target marked with figures. The dart game has an advantage in that anybody can enjoy the dart game anytime if there are only an arrow-headed dart and a dart game apparatus. In recent years, as various game methods have been developed and scoring methods have been organized, the dart game has been developed as worldwide leisure, and therefore, men and women of all ages have conveniently enjoyed the dart game.

As the demand for dart games is increasing, there are often places where a dart game apparatus is provided in commercial facilities such as a cafe, a restaurant, a bar, etc., and dart game fields that have a plenty of dart game apparatuses and provide entertainment to persons are also generated.

However, unlike the days when a player throws a pointed dart pin with a needle to a dart target made of wood or cork in the past to simply calculate a score, dart game apparatuses which are electrically operated form a mainstream for a safety reason or in order to add various entertainment factors, nowadays.

Even though such an electronic dart game apparatus has a large volume, the electronic dart game apparatus is difficult to modularize, and as a result, there is a disadvantage in that the electronic dart game apparatus is inconvenient to move. Further, as the demand for the dart game is increasing, the dart game apparatus does not just provide only the dart target and the score in order to satisfy tastes of various consumers, but additionally has various additional apparatuses.

As the number of functions of the dart game apparatus increases, consumers may enjoy a dart game more interestingly, but the volume of the dart game apparatus also increases, and as a result, a problem may occur when the dart game apparatus is transported. In some commercial facilities, a size of the dart game apparatus is designed to be smaller than a width of a door, and as a result, there is a case where the dart game apparatus should be transported by a method for disassembling, and then reassembling the dart game apparatus. Alternatively, when multiple dart game apparatuses are loaded on a truck and transported, the volume of the dart game apparatus is large and a structure is not simple, and as a result, the dart game apparatuses may not be efficiently loaded.

Accordingly, there is a demand for a dart game apparatus which has various additional functions installed therein, and is easy to transport while providing an interest to a user.

SUMMARY OF THE INVENTION

The present disclosure is contrived to correspond to the background art, and has been made in an effort to provide a method that can provide a dart game apparatus which has various additional functions and is easy to transport.

However, technical objects of the present disclosure are not restricted to the technical object mentioned as above. Other unmentioned technical objects will be apparently appreciated by those skilled in the art by referencing to the following description.

An exemplary embodiment of the present disclosure provides a dart game apparatus. The dart game apparatus may include: a body part in which a dart target is installed on a front surface; a support unit including a coupling unit coupled to an upper side of the body part and an extension unit formed to extend toward a front surface of the coupling unit; and a lid unit rotatably coupled to the support unit through at least one hinge.

The dart game apparatus may further include: a camera unit provided in the lid unit and disposed toward the front surface of the body part in a state in which at the least one hinge is unfolded; and a target illumination unit provided in the lid unit and irradiating light toward the front surface of the body part in a state in which the at least one hinge is unfolded.

The support unit may further include at least one fixation unit provided on a lower surface of the extension unit, and the lid unit may include at least one latch unit rotatably provided on a lower surface of the lid unit and having a seating groove into which the at least one fixation unit is inserted.

When the at least one fixation unit is inserted into the seating groove provided in the at least one latch unit in a state in which the at least one hinge is unfolded, the at least one hinge may maintain the unfolded state.

The at least one fixation unit may include a first member having a second diameter larger than a first diameter of an inner diameter of the seating groove, and a second member provided between the first member and the lower surface of the lid unit, and inserted into the seating groove.

A thickness of the at least one latch unit may be equal to or smaller than a length between the lower surface of the lid unit and the first member.

The extension unit may further include a first upper surface portion, and a first lateral surface portion and a second lateral surface portion formed to extend toward a lower portion from both lateral surfaces of the first upper surface portion so that a first space is formed at a lower portion of the first upper surface portion, and the lid unit may include a second upper surface portion, a third lateral surface portion and a fourth lateral surface portion formed to extend toward a lower portion from both lateral surfaces of the second upper surface portion so that a second space is formed at a lower portion of the second upper surface portion, and a front surface portion formed to extend toward the lower portion on the front surface of the second upper surface portion.

Further, in the at least one hinge, one side may be coupled to a lower surface of the first upper surface portion and other side may be coupled to a lower surface of the second upper surface portion.

A first length which is a length between the first lateral surface portion and the second lateral surface portion may be equal to or less than a second length which is a length between the third lateral surface portion and the fourth lateral surface portion.

In a state in which the at least one hinge is folded, at least parts of the first lateral surface portion and the second lateral surface portion may be inserted into the second space.

A third length of the extension unit which is a length formed to extend from the coupling unit may be equal to or longer than a fourth length which is a length from one upper end to other lower end of the lid unit.

Technical solving means which can be obtained in the present disclosure are not limited to the aforementioned solving means and other unmentioned solving means will be clearly understood by those skilled in the art from the following description.

According to an exemplary embodiment of the present disclosure, a dart game apparatus which is easy to transport can be provided.

Effects which can be obtained in the present disclosure are not limited to the aforementioned effects and other unmentioned effects will be clearly understood by those skilled in the art from the following description.

BRIEF DESCRIPTION OF THE DRAWINGS

Various aspects are now described with reference to the drawings and like reference numerals are generally used to designate like elements. In the following exemplary embodiments, for the purpose of description, multiple specific detailed matters are presented to provide general understanding of one or more aspects. However, it will be apparent that the aspect(s) can be executed without the specific detailed matters. In other examples, known structures and apparatuses are illustrated in a block diagram form in order to facilitate description of the one or more aspects.

DETAILED DESCRIPTION

Figure 1:
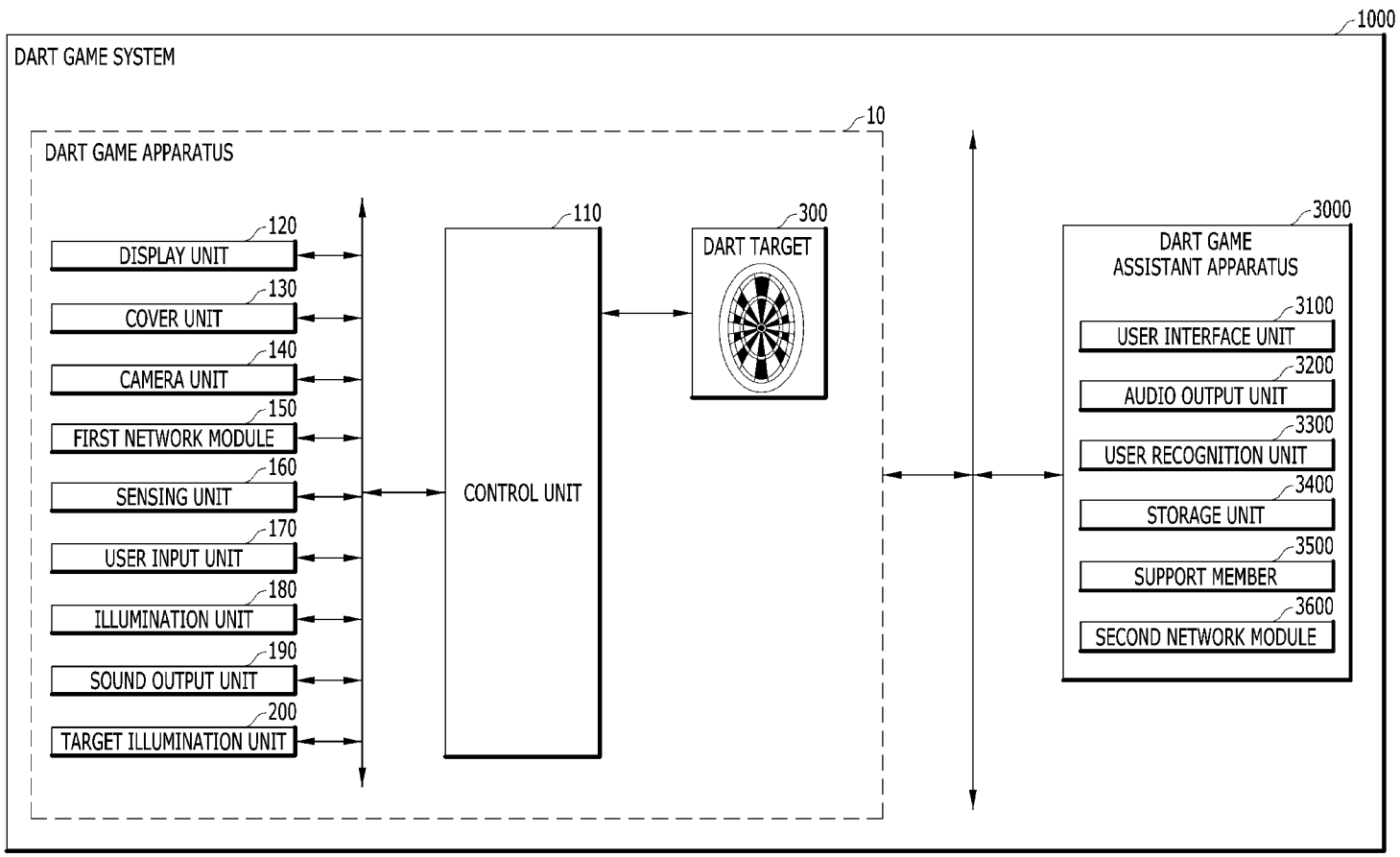
FIG. 1 is a block diagram for describing components of a dart game system according to some exemplary embodiments of the present disclosure.

Various exemplary embodiments and/or various aspects will be disclosed with reference to the drawings. In the following descriptions, for explanation, multiple specific details are disclosed in order to provide overall understandings of one or more aspects. However, it will also be appreciated by those skilled in the art that this aspect(s) may be practiced without these specific details. The following descriptions and the accompanying drawings are provided for disclosing specific exemplary aspects of the one or more aspects in detail. However, these aspects are exemplary. Thus, some of the various methods in the principles of the various aspects may be used, and the descriptions are intended to include all such aspects and their equivalents. Specifically, "an exemplary embodiment", "an example", "an aspect", and the like used in this specification may not be construed as any aspect or design described being better or advantageous than other aspects or designs.

Hereinafter, the same or similar constituent elements are assigned with the same reference numerals regardless of reference numerals, and the repetitive description thereof will be omitted. In addition, in the description of the exemplary embodiment disclosed in the present specification, the specific descriptions of publicly known related technologies will be omitted when it is determined that the specific descriptions may obscure the subject matter of the exemplary embodiment disclosed in the present specification. In addition, the accompanying drawings are provided only to allow those skilled in the art to easily understand the exemplary embodiments disclosed in the present specification, and the technical spirit disclosed in the present specification is not limited by the accompanying drawings.

Terms "first", "second", and the like may be used to describe various elements and components, but the elements and components are of course not limited by these terms. These terms are merely used to distinguish one element or component from another element or component. Therefore, the first element or component mentioned hereinafter may of course be the second element or component within the technical spirit of the present disclosure.

Unless otherwise defined, all terms (including technical and scientific terms) used in the present specification may be used as the meaning which may be commonly understood by the person with ordinary skill in the art, to which the present disclosure belongs. In addition, terms defined in a generally used dictionary shall not be construed in ideal or excessively formal meanings unless they are clearly and specially defined in the present specification.

The term of "or" is intended to mean not an exclusive "or" but an inclusive "or". That is, unless specified or clear in context, "X uses A or B" is intended to mean one of the natural implicit substitutions. That is, "X uses A or B" can be applied to any of the cases where X uses A, X uses B, or X uses both A and B. Moreover, it is to be understood that the term of "and/or" used in this specification refers to and includes all possible combinations of one or more of the listed related items.

It is to be understood that the terms of "comprises" and/or "comprising" mean that the feature and/or a component is provided, but one or more other features, other components and/or the presence or addition of groups thereof are not excluded. In addition, unless specified or clear in the context of indicating a singular form, the singular in this specification and claims should generally be construed to mean "one or more".

The terms "information" and "data" used in the present specification may sometimes be interchangeably used.

The suffixes "module" and "unit" used to describe some constituent elements in the following description are used together or interchangeably in order to facilitate the description, but the suffixes themselves do not have distinguishable meanings or functions.

When one constituent element is described as being "connected" or "coupled" to another constituent element, it should be understood that one constituent element can be connected or coupled directly to another constituent element, and an intervening constituent element can also be present between the constituent elements. When one constituent element is described as being "connected directly to" or "coupled directly to" another constituent element, it should be understood that no intervening constituent element is present between the constituent elements.

When an element or layer is referred to as being "on" another element or layer, it can be directly on the other element or layer or intervening elements or layers may be present. In contrast, when an element is referred to as being "directly on" another element or layer, there are no intervening elements or layers present.

Spatially relative terms, such as "below," "beneath," "lower," "above," "upper," and the like, may be used herein for ease of description to describe one constituent element or a correlation between one constituent element and other constituent elements, as illustrated in the drawings. It should be understood that the spatially relative terms encompass different orientations of the elements in use or operation in addition to the orientation depicted in the drawings.

For example, if the constituent element in the drawings is turned over, the constituent element described as "below" or "beneath" the other constituent element may then be oriented "above" the other constituent element. Thus, the exemplary term "below" can encompass both orientations of above and below. The constituent elements may be oriented in different directions, and the spatially relative terms used herein may be interpreted in accordance with the orientations.

Objects and effects of the present disclosure and technical constituent elements for achieving the objects and effects will be clear with reference to the exemplary embodiments described in detail below together with the accompanying drawings. In addition, in the description of the present disclosure, the specific descriptions of publicly known functions or configurations will be omitted when it is determined that the specific descriptions may unnecessarily obscure the subject matter of the present disclosure. In addition, the terms used herein are defined considering the functions in the present disclosure and may vary depending on the intention or usual practice of a user or an operator.

The scope of the claims for the method in the claims of the present disclosure arises from the functions and features described in each step and is not affected by the order in which each step in the claims disclosed if a sequence relationship of the disclosure order in respective steps constituting the method is not specified. For example, in the claims set forth in the method including steps A and B, the scope of rights is not limited to the fact that step A precedes step B, even if step A is described before step B.

However, the present disclosure is not limited to the exemplary embodiments disclosed herein but will be implemented in various forms. The exemplary embodiments of the present disclosure are provided so that the present disclosure is completely disclosed, and a person with ordinary skill in the art can fully understand the scope of the present disclosure. The present disclosure will be defined only by the scope of the appended claims. Therefore, the definition of the terms should be made based on the entire contents of the technology of the present specification.

A dart game apparatus 10 according to the present disclosure may photograph a dart target and a dart game user through at least one camera unit provided in the dart game apparatus 10 while a player plays a dart game. This is a factor that causes an interest of the player, and an image photographed by at least one camera unit may be displayed through at least one display unit provided in the dart game apparatus 10.

At least one camera may be disposed spaced apart from the dart target by a predetermined distance and to photograph the dart target in order for at least one camera to photograph the dart target.

To this end, in the dart game apparatus 10 according to the present disclosure, a roof-shaped structure may be coupled to an upper surface of a body part. Further, the roof-shaped structure added to the dart game apparatus 10 may be folded or unfolded according to a surrounding situation. Hereinafter, a dart game system 1000 including the dart game apparatus 10 according to the present disclosure will be described through FIGS. 1 to 8.

FIG. 1 is a block diagram for describing components of a dart game system according to some exemplary embodiments of the present disclosure.

According to some exemplary embodiments of the present disclosure, a dart game system 1000 may include a dart game apparatus 10 and a dart game assistant apparatus 3000. However, components described above are not required in implementing the dart game system 1000 and the dart game system 1000 may thus have components more or less than components listed above.

The dart game apparatus 10 may include a control unit 110, a display unit 120, a cover unit 130, a camera unit 140, a first network module 150, a sensing unit 160, a user input unit 170, an illumination unit 180, a sound output unit 190, a target illumination unit 200, and a dart target 300. However, the present disclosure is not limited thereto.

The control unit 110 generally controls all motions of the dart game apparatus 10. The control unit 110 processes a signal, data, information, and the like input or output through the components mentioned above or drives the application program stored in a memory (not illustrated) to provide or process information or a function appropriate for the user.

For example, the control unit 110 may aggregate a score input through the dart game play for each game participant. In addition, the control unit 110 may share an aggregated result with another dart game apparatus through a network.

The display unit 120 may be formed in a first area other than an area in which the dart target 300 is provided on a front surface of the dart game apparatus 10. Here, the front surface of the dart game apparatus 10 may be a surface visually exposed when the user views the dart game apparatus 10 beyond a throw-line. In addition, the first area may be an entire area other than a second area in which the dart target is positioned on the front surface of the dart game apparatus 10, and may be an area other than the second area and a periphery area of the dart game apparatus 10 on the front surface of the dart game apparatus 10. However, the present disclosure is not limited thereto.

By constituting the first area of the front surface of the dart game apparatus 10 by the display unit 120, it is possible to express a visual effect that is differentiated from the dart game apparatus in the related art. However, the present disclosure is not limited thereto.

Specifically, due to characteristics of the dart game, primary plays on the game may be conducted primarily on the dart target 300. In addition, in the dart target 300 and the first area positioned around the dart target 300, a visual concentration of the player is relatively high. That is, the first area may be an area in which the visual concentration of the user is high. Accordingly, the dart game apparatus 10 according to the present disclosure outputs various visual effects to the first area to enhance satisfaction or immersion of the user. Hereinafter, the first area will be described below through FIGS. 2 to 4.

The display unit 120 may include at least one of a liquid crystal display (LCD), a thin film transistor-liquid crystal display (TFT LCD), an organic light-emitting diode (OLED), a flexible display, a 3D display, and an electronic ink (e-ink) display. However, the present disclosure is not limited thereto.

The cover unit 130 may be provided adjacent to the display unit 120 on the front surface of the display unit 120 to protect the display unit 120. For example, the cover unit 130 may be positioned between a throw-line on which a player who throws a dart pin and the display unit 120. In this case, the cover unit 130 is positioned adjacent to the display unit 120 on the front surface of the display unit 120 to reduce a risk of damage to the display unit 120. As another example, the cover unit 130 may be provided in contact with the display unit 120. However, the present disclosure is not limited thereto.

In the present disclosure, the dart target 300 may be seated on the cover unit 130. For example, the dart target 300 may be seated on a hole (131 in FIG. 4) which is present in the cover unit 130. Hereinafter, a shape of the cover unit 130 will be described below through FIGS. 3 and 4.

Meanwhile, at least a part of the cover unit 130 may have optical transmittance. For example, a part of the cover unit 130 may be transparent, the other part may be translucent, and another part may be opaque. However, the present disclosure is not limited thereto.

The camera unit 140 may include at least one camera. An image frame processed by the camera unit 140 may be stored in the memory or transmitted to the outside through the first network module 150. Two or more camera units 140 may be provided according to a use environment.

Figure 2:
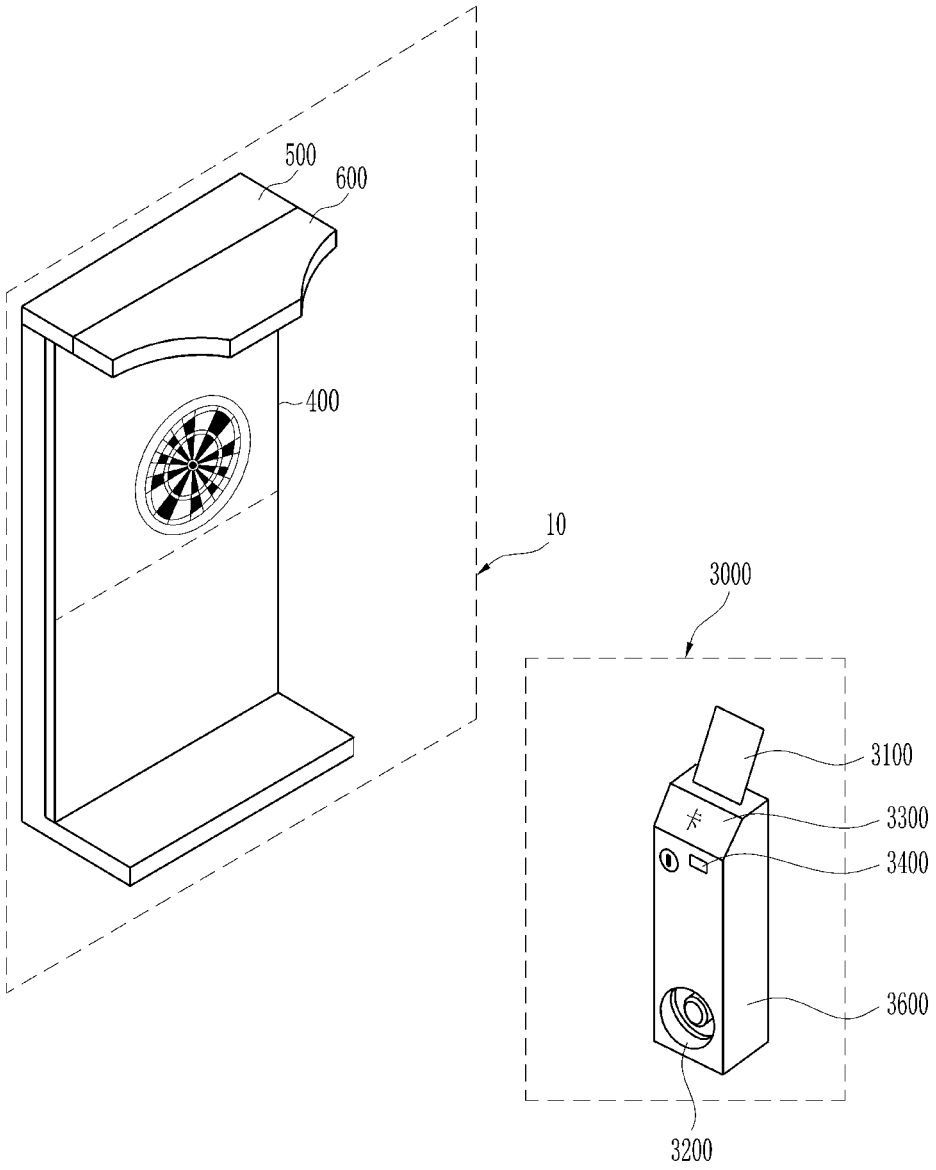
FIG. 2 is a diagram for describing an example of a dart game system according to some exemplary embodiments of the present disclosure.

Specifically, the camera unit 140 may include a first camera disposed to face a front surface of the body part (400 in FIG. 2). Further, the camera unit 140 may include a second camera disposed on the front surface of the body part to photograph at least one user who uses the dart game apparatus. However, the present disclosure is not limited thereto. Here, the first camera may photograph the dart target and the second camera may photograph the user.

The image photographed by the camera unit 140 may be output to the display unit 120 through control by the control unit 110.

In this case, the image photographed by the camera unit 140 may be output to different areas within the display unit 120. For example, an area in which the image photographed by a first camera included in the camera unit 140 is displayed may be different from an area in which the image photographed by a second camera included in the camera unit 140 is displayed. In this case, the image photographed by the first camera may include an image for the dart target. Further, the image photographed by the second camera may include an image of the dart game user. However, the present disclosure is not limited thereto.

A location at which the image photographed by the camera unit 140 is output may vary depending on the dart game user. For example, a location where the photographed image is displayed when the camera unit 140 photographs an image related to the dart game of a first user and a location where the photographed image is displayed when an image related to the dart game of a second user is photographed by the camera unit 140 may be different from each other.

In the exemplary embodiment of the present disclosure, at least one of the cameras constituting the camera unit 140 may be used to measure a throwing speed of the dart pin. For example, at least one camera photographs two or more dart pin images at a predetermined time interval to measure a movement speed of the dart pin. As another exemplary embodiment, the movement speed of the dart pin may be measured using the images of the dart pins photographed by the two or more cameras and positional relationship information of the two or more cameras, which is preset. However, the present disclosure is not limited thereto.

The first network module 150 may perform a communication function with the dart game assistant apparatus 3000 and at least one user terminal under the control by the control unit 110.

The first network module 150 may use various wired communication systems such as public switched telephone network (PSTN), x digital subscriber line (xDSL), rate adaptive DSL (RADSL), multi rate DSL (MDSL), very high speed DSL (VDSL), universal asymmetric DSL (UADSL), high bit rate DSL (HDSL), and local area network (LAN).

The first network module 150 presented here may use various wireless communication systems such as code division multi access (CDMA), time division multi access (TDMA), frequency division multi access (FDMA), orthogonal frequency division multi access (OFDMA), single carrier-FDMA (SC-FDMA), and other systems.

In the present disclosure, the first network module 150 may be configured regardless of communication modes such as wired and wireless modes and constituted by various communication networks including a personal area network (PAN), a wide area network (WAN), and the like. Further, the network may be known World Wide Web (WWW) and may adopt a wireless transmission technology used for short-distance communication, such as infrared data association (IrDA) or Bluetooth.

The sensing unit 160 may sense the play of a dart game player (e.g., a real player) input into the dart target 300.

For example, the sensing unit 160 may sense the hit location of the dart pin. The sensing unit 160 may electrically convert a score corresponding to the area which the dart hits to transmit the converted score to the control unit 110. In this case, the control unit 110 may acquire a score based on information on the hit location of the dart, which is acquired from the sensing unit 160.

Meanwhile, the sensing unit 160 may include piezoelectric elements. The piezoelectric elements may mean any type of element that generates an electrical signal in response to a change or change rate of pressure applied to the element. When the dart pin hits the dart target 300, the electrical signal may be generated by the piezoelectric element in accordance with the pressure applied to the corresponding segment. At least partially based on the electrical signal, the control unit 110 may determine a speed of the dart pin.

For example, the dart pin is thrown and flies, and reaches the dart target and stops. When the dart pin is completely stopped and there is no change in the shape of the piezoelectric element due to the dart pin, the electrical signal of the piezoelectric element also disappears. Therefore, an interval between the time when voltage starts to be generated by the piezoelectric element and the time when the generation of the electrical signal by the piezoelectric element disappears may be measured. When the measured time and acceleration are known, a throwing speed of the dart pin may be calculated.

The user input unit 170 receives an input of the user for controlling the dart game apparatus 10. The user input unit 170 may be implemented by at least one of a keypad, a dome switch, a touch pad (resistive/capacitive), a jog wheel, and a jog switch. However, the present disclosure is not limited thereto.

In the present disclosure, the user input unit 170 may also include a short-range communication unit (not illustrated). When the user input unit 170 includes the short-range communication unit of the first network module 150, the user input unit 170 may be configured to receive the user input which is input by an external device.

For example, when the user input unit 170 performs the short range communication using infrared communication, the external device may be an infrared remote controller. As another example, when the user input unit 170 performs the short range communication using a Bluetooth function, the external console device may be a mobile device including a Bluetooth module. The mobile device including the Bluetooth module may be, for example, a smartphone.

In the present disclosure, the user input unit 170 may receive information on the dart pin. For example, the dart game system 1000 may be input with information included in a dart pin identification module such as an NFC chip or an RFID chip embedded in the dart pin through the user input unit 170. As an example, the information on the dart pin may include mass information, weight information, manufacturer information, length information, shape information, and/or predetermined identification information for identifying the dart pin.

Meanwhile, in the present disclosure, the user input unit 170 may be provided in the dart game assistant apparatus 3000. In this case, the motion and the function which may be performed through the user input unit 170 may be replaced or paralleled with at least one of the components provided in the dart game assistant apparatus 3000. A detailed description for the dart game assistant apparatus 3000 will be described below.

The illumination unit 180 may output a signal for announcing occurrence of an event of the dart game apparatus 10. Here, the event which occurs in the dart game apparatus 10 may be identification of the dart game player, direct hit of the dart, a change of the dart game player, game over, and the like.

The illumination unit 180 may include a light emission diode (LED) and announce the occurrence of the event to the user by flickering the LED. The illumination unit 180 may vary and output the type of light emission, the intensity of light emission, or the flicker cycle depending on the position at which the dart pin reaches the dart target.

Meanwhile, the illumination unit 180 may be disposed on the bottom of the dart target 300 and flickered according to a flickering pattern which is pre-stored according to the occurrence of the event. For example, one or more LEDs may be allocated to respective parts of the dart target 300. The allocated LEDs are disposed on the bottom of the dart target 300 and may be disposed in a direction orienting the outside of the dart game apparatus 10. When the LEDs irradiate light, the light irradiated by the LEDs may pass through the dart target 300 made of a transparent or translucent material to transfer a visual output to the user. Alternatively, the light irradiated by the LEDs may transfer the visual output to the user through a gap existing in the dart target 300. As another example, the LEDs may be arranged linearly or nonlinearly along both sides of the dart game apparatus 10. In this case, the LEDs may extend to a bottom along both sides of the dart game apparatus 10 and may be disposed additionally extend along the side of the throwline. However, the present disclosure is not limited thereto.

The sound output unit 190 may output audio data received from the first network module 150 or stored in the memory during a motion such as a sound effect of the game, a game motion guide, a game method description, and the like. The sound output unit 190 may also output a sound signal related with a function (e.g., the game sound effect) performed by the dart game apparatus 10. The sound output unit 190 may also output a speech of a game player or a third person using another dart game apparatus, which is received through the first network module 150. The sound output unit 190 may include a receiver, a speaker, a buzzer, and the like. Additionally, the sound output unit 190 may vary and output a volume/a type of music according to the location where the dart pin reaches the dart target. However, the present disclosure is not limited thereto.

The target illumination unit 200 may irradiate light toward the front surface of the body part 400. For example, the target illumination unit 200 may irradiate the light toward the dart target 300. However, the present disclosure is not limited thereto.

Meanwhile, the target illumination unit 200 may output the signal for announcing the occurrence of the event of the dart game apparatus 10.

For example, the target illumination unit 200 may include the LED to irradiate the light toward the front surface of the body part 400 through flicking of the LED. Additionally, the target illumination unit 200 may vary and output the type of light emission, the intensity of light emission, and/or the flicker cycle depending on the location at which the dart pin reaches the dart target 300. However, the present disclosure is not limited thereto.

Figure 6:
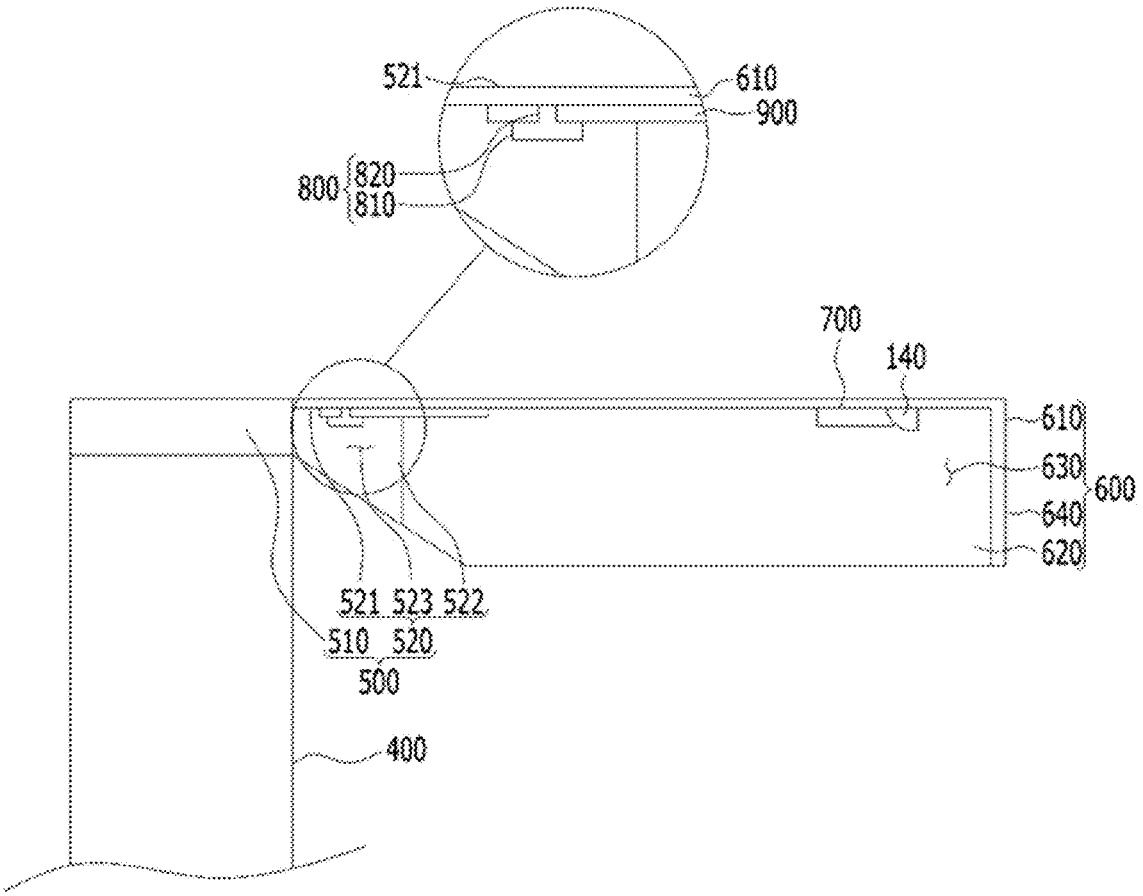
FIG. 6 is a diagram illustrating a cross-sectional view of A-A' of FIG. 3 in order to describe a support unit and a lid unit in a dart game apparatus according to some exemplary embodiments of the present disclosure.

In the present disclosure, the target illumination unit 200 may be disposed in a lid unit (700 in FIG. 6). However, although not limited thereto, the target illumination unit 200 may be disposed at least partially in contact with the cover unit 130. For example, the target illumination unit 200 may be disposed on one surface of the cover unit 130 facing the dart game apparatus 10.

Meanwhile, the control unit 110 may determine the area where the target illumination unit 200 irradiates the light at least partially based on the location which the dart pin hits.

For example, when the dart pin reaches the dart target 300, the sensing unit 160 may obtain information on the location where the dart pin reaches the dart target 300 and the control unit 110 may determine the area to which the target illumination unit 200 irradiates the light at least partially based on the obtained location information.

Specifically, the control unit 110 may determine the area which the dart pin hits as the area where the target illumination unit 200 irradiates the light.

A portion adjacent to a point where a line extending from the center of the dart target 300 to the location which the dart pin hits meets the outline of the dart target may be determined as the area to which the target illumination unit 200 irradiates the light.

Meanwhile, the control unit 110 may determine a portion matching the location which the dart pin hits as the area to which the target illumination unit 200 irradiates the light. For example, when the dart pin hits a specific location, the control unit 110 may determine an area matching the hit location as the area to which the target illumination unit 200 irradiates the light.

The control unit 110 may determine a portion matching an area including the location which the dart pin hits as a location at which an event effect is to be displayed. For example, the dart target 300 may be divided into a plurality of fan-shaped areas and the control unit 110 may determine a portion adjacent to an arc of the fan-shaped area including the portion which the dart pin hits as the area to which the target illumination unit 200 irradiates the light.

The control unit 110 may determine an area which belongs to a predetermined distance range from the location within the dart target to which the dart pin is thrown as the area to which the target illumination unit 200 irradiates the light.

Meanwhile, the control unit 110 may determine at least one of a pattern in which the target illumination unit 200 irradiates the light and a duration of the irradiated light, at least partially based on the location which the dart pin hits.

Specifically, when the dart pin hits a predetermined location, the control unit 110 may determine a pattern based on the location where the dart pin is determined as the pattern in which the target illumination unit 200 irradiates the light.

As an example, in the case where the dart pin hits a double score area, the control unit 110 may control the target illumination unit 200 to flicker twice or control the target illumination unit 200 to irradiate the light during a duration which is relatively two times longer than the case where the dart pin hits a single score area.

As another example, in the case where the dart pin hits a triple score area, the control unit 110 may control the target illumination unit 200 to flicker three times or control the target illumination unit 200 to irradiate the light during a duration which is relatively three times longer than the case where the dart pin hits a single score area. However, the present disclosure is not limited thereto.

The dart target 300 may include a score board in which a bull's eye is positioned at the center and there are areas segmented by a concentric circle centering the bull's eye and straight lines extended radially from the bull's eye and granted with individual scores, respectively.

Multiple receiving grooves into which a tip of a dart may be inserted may be formed on the score board. In this case, shapes of areas at which the scores are arranged and to which the scores are granted in the dart target 300 may be variably changed. Further, the dart target 300 may be implemented in the form of a touch screen. However, the present disclosure is not limited thereto.

In the present disclosure, the dart game apparatus 10 may further include a memory (not illustrated).

The memory may store a program for a motion of the control unit 110 therein and temporarily store input/output data (e.g., a phone book, a message, a still image, a moving picture, or the like) therein.

The memory may store data regarding various patterns of vibrations and sounds output to correspond to the motion input through the user input unit.

The memory may include at least one type of storage medium of a flash memory type storage medium, a hard disk type storage medium, a multimedia card micro type storage medium, a card type memory (for example, an SD or XD memory, or the like), a random access memory (RAM), a static random access memory (SRAM), a read-only memory (ROM), an electrically erasable programmable read-only memory (EEPROM), a programmable read-only memory (PROM), a magnetic memory, a magnetic disk, and an optical disk. The dart game apparatus 10 may operate in connection with a web storage performing a storing function of the memory on the Internet. However, the present disclosure is not limited thereto.

In the present disclosure, the dart game assistant apparatus 3000 may have various components for the function which may be performed by the dart game apparatus 10 and a function which may be autonomously performed. Further, the dart game assistant apparatus 3000 may be disposed on the ground while being spaced apart from the dart game apparatus 10 by a predetermined distance in an opposite direction to the dart target 300. However, the present disclosure is not limited thereto.

The dart game assistant apparatus 3000 may include a user interface unit 3100, an audio output unit 3200, a user recognition unit 3300, a storage unit 3400, and a support member 3500. However, the present disclosure is not limited thereto.

The user interface unit 3100 may be a device that receives an input of the user for controlling the dart game apparatus 10. The user interface unit 3100 may include a keypad, a dome switch, a touch pad (resistive/capacitive), a jog wheel, a jog switch, a touch screen having a display function, and like. However, the present disclosure is not limited thereto.

The user interface unit 3100 may receive an input of the user for controlling the display unit 120 of the dart game apparatus 10. For example, the dart game user may adjust the size of the variable screen displayed on the display unit 120 through the user interface unit 3100. Specifically, the display unit 120 may be divided into a plurality of areas and at least one of the sizes of the plurality of respective areas may be adjusted by the user interface unit 3100.

At least one location among the plurality of areas may be adjusted by the user interface unit 3100. Specifically, the location of at least one of the plurality of areas may be moved to the upper portion of the display unit 120 by an input of a user input from the user interface unit 3100. Further, the location of at least one of the plurality of areas may be moved to the lower portion of the display unit 120 by an input of a user input from the user interface unit 3100.

A screen displayed in at least one area among the plurality of areas included in the display unit 120 may be adjusted by the user interface unit 3100. For example, when the variable screen for the dart game user is preset to be displayed in a first area, the preset display of the variable screen may be changed to displaying the screen for the dart target 300 by the control signal input through the user interface unit 3100. As another example, the screen for game progress information may be set to be displayed in the first area by the control signal input through the user interface unit 3100.

In this case, the screen adjusted by the user interface unit 3100 may include at least one of the image photographed by the camera unit 140, an image received from another dart game apparatus, an image received from the external device, information on the dart game which is currently progressed, acquired information depending on a current dart hitting location, the event effect of the dart game, a lesson image for the dart game, an expected acquired score, and an advertisement image. However, the present disclosure is not limited thereto.

Meanwhile, the screen may be displayed even in the user interface unit 3100. Here, the screen displayed in the user interface unit 3100 may include at least one of the image photographed by the camera unit 140, an image received from another dart game apparatus, an image received from the external device, information on the dart game which is currently progressed, acquired information depending on a current dart hitting location, the event effect of the dart game, a lesson image for the dart game, an expected acquired score, and an advertisement image.

In this case, the screen displayed in the display unit 120 and the screen displayed in the user interface unit 3100 may be interlocked. For example, the screen displayed in the user interface unit 3100 may be the same as at least one of the variable screens displayed in the display unit 120.

Alternatively, the screen displayed in the user interface unit 3100 may be a reduced screen of at least one of the screens displayed in the display area.

In this case, the screen displayed on the user interface unit 3100 may be at least one of the images displayed in the display unit 120, which may be adjusted by the control signal received by the user interface unit 3100. For example, a plurality of screens may be displayed in the display unit 120, and a screen selected by the user through the user interface unit 3100 among the plurality of variable screens may be displayed in the user interface unit 3100. However, the present disclosure is not limited thereto.

The control unit 110 may adjust the input information that may be input by the user interface unit 3100, partially based on at least one of the identification information of the user and pre-stored user designation information. For example, each of the dart game users may pre-store the information that may be input through the user interface unit 3100 and when the user is identified based on the identification information acquired by the dart game apparatus 10, the control unit 110 may adjust the information which may be input through the user interface unit 3100 based on the pre-stored information. In this case, the adjusted information may include at least one of the information on selection and cancellation of the game mode, the information on selection and cancellation of the player, information on a dart game execution history, information on user authentication, and information related with payment of a dart game expense, but is not limited thereto.

The control unit 110 may determine whether to activate the user interface unit 3100 partially based on at least one of the identification information of the user and the pre-stored user designation information. For example, each of the dart game users may pre-store information indicating whether to use the user interface unit 3100 and when the dart game user is identified based on the identification information acquired by the dart game apparatus 10, the control unit 110 may determine whether to activate the user interface unit 3100 based on the pre-stored information. However, the present disclosure is not limited thereto.

The audio output unit 3200 interlocks with the dart game apparatus 10 to output a sound related to an event generated in the dart game apparatus 10. For example, the audio output unit 3200 may output audio data received from the first network module 150 or stored in the memory in a sound effect of the game, a game motion guide, game method description, and the like. The audio output unit 3200 may output a sound signal related with the function (e.g., the game sound effect) performed by the dart game apparatus 10. The audio output unit 3200 may also output a speech of a game player or a third person using another dart game apparatus, which is received through the first network module 150. The audio output unit 3200 may include a receiver, a speaker, a buzzer, and the like. However, the present disclosure is not limited thereto.

Meanwhile, the audio output unit 3200 may vary and output a volume/a type of music according to the location where the dart pin reaches the dart target 300. Additionally, the audio output unit 3200 may vary and output the volume/the type of music so as to correspond to the speed of the dart pin.

In this case, the audio output unit 3200 is positioned relatively closer to the dart game user than the sound output unit 190 provided in the dart game apparatus 10 and generates the sound to enhance an interest of the dart game.

The user recognition unit 3300 may recognize unique information of a long-range user by using a radio wave through the radio frequency identification (RFID) technology which is a kind of the short range communication technology. For example, the user may possess a card, a mobile terminal, or unique dart game equipment (for example, his/her own personal dart equipment) which includes an RFID module. Information (e.g., a personal ID, an identification code, and the like of the user registered in the database server) for identifying the user may be recorded in the RFID module possessed by the user. The user recognition unit 3300 may identify the RFID module possessed by the user to identify a dart game player which plays the game by using the dart game apparatus 10 and update a database for the identified dart game player or accumulate new data.

Meanwhile, the user recognition unit 3300 may use various technologies (e.g., the short-range communication technology such as the Bluetooth, and the like) that may transmit and receive unique information of the user by a contact/non-contact method in addition to the RFID technology. Further, the user recognition unit 3300 may include a biodata identification module that identifies biodata (speech, a fingerprint, and a face) of the user by interworking with the microphone of the user interface unit 3100, the touch pad, the camera unit 140, and the like.

Meanwhile, the user recognition unit 3300 may include at least one camera which may recognize a QR code, a barcode, etc.

Specifically, when the QR code or the barcode is provided in the dart pin of at least one user or the user terminal of at least one user, at least one camera may recognize at least one of the QR code or the barcode. In addition, information recognized by at least one camera may be transmitted to the dart game apparatus 10 under the control by the control unit 110. In this case, the dart game apparatus 10 may check a game credit of at lest one user based on at least one received information or at least one user may display a preset screen in the display unit 120. However, the present disclosure is not limited thereto.

The storage unit 3400 may store a bill or a coin for performing the dart game. For example, the storage unit 3400 may store bills such as 1000 won or 5000 won directly from the dart game user.

The storage unit 3400 can acquire game credits from the dart game user. For example, the storage unit 3400 may acquire the game credits through the RFID card of the dart game user and acquire the game credits through the first network module 150. Here, the game credit may mean money required for performing the dart game.

Meanwhile, a credit card or a check card for performing the dart game may be inserted into the storage unit 3400. In this case, the control unit 110 settles the game credit by using the credit card or the check card inserted into the storage unit 3400 to generate the dart game credit. Further, although not limited thereto, the storage unit 3400 may acquire the game credit from the user by various methods.

The support member 3500 may form an external appearance of the dart game assistant apparatus 3000.

Specifically, the support member 3500 may be provided by forming a predetermined height from the ground so that the user conveniently uses the user interface unit 3100.

The second network module 3600 may perform a communication function with the dart game apparatus 10 and at least one user terminal under the control by the control unit 110.

The second network module 3600 may use various wired communication systems such as public switched telephone network (PSTN), x digital subscriber line (xDSL), rate adaptive DSL (RADSL), multi rate DSL (MDSL), very high speed DSL (VDSL), universal asymmetric DSL (UADSL), high bit rate DSL (HDSL), and local area network (LAN).

The second network module 3600 presented here may use various wireless communication systems such as code division multi access (CDMA), time division multi access (TDMA), frequency division multi access (FDMA), orthogonal frequency division multi access (OFDMA), single carrier-FDMA (SC-FDMA), and other systems.

In the present disclosure, the second network module 3600 may be configured regardless of communication modes such as wired and wireless modes and constituted by various communication networks including a personal area network (PAN), a wide area network (WAN), and the like. Further, the network may be known World Wide Web (WWW) and may adopt a wireless transmission technology used for short-distance communication, such as infrared data association (IrDA) or Bluetooth.

According to the above-described configuration, the dart game system 1000 may provide, to the user, a dart game including various convenience and entertainments through the dart game apparatus 10 and the dart game assistant apparatus 3000 provided outside the dart game apparatus 10. Hereinafter, a shape of the dart game system 1000 which may be implemented in the present disclosure will be described through FIG. 2.

FIG. 2 is a diagram for describing an example of a dart game system according to some exemplary embodiments of the present disclosure. The contents disclosed in FIG. 1 are referred to for a feature duplicated with the feature described above in relation to FIG. 1 among the features for the contents illustrated in FIG. 2 and here, a description thereof will be omitted.

Referring to FIG. 2, the dart game system 1000 may include the dart game apparatus 10 and the dart game assistant apparatus 3000.

The dart game user may enjoy the dart game through the dart game apparatus 10.

When the dart game apparatus 10 is provided in one area, the dart game assistant apparatus 3000 may be disposed spaced apart by a predetermined distance in an opposite direction to the dart target 300.

In this case, the input for the dart game apparatus 10 is performed through the user interface unit 3100 provided in the dart game assistant apparatus 3000, and as a result, various situations may not occur, which are inconvenient for the dart game user.

For example, the dart game user may perform the input in the dart game apparatus 10 through the user interface unit 3100 provided in the dart game assistant apparatus 3000, and as a result, there is no need to move to the dart game apparatus 10 in order to perform the input in the dart game apparatus 10. In particular, this allows the dart game user to directly perform the input for the dart game without the need to move to the dart game apparatus 10 when the dart game user is a disabled person (e.g., a person with a leg injury, etc.).

Meanwhile, the support member 3500 may include the user interface unit 3100 provided on the upper surface thereof. Further, the storage unit 3400 for acquiring the game credit from at least one user may be provided on the front surface of the support member 3500. Accordingly, at lest one user may conveniently use the dart game assistant apparatus 3000. However, the present disclosure is not limited thereto.

Meanwhile, in the present disclosure, the display unit 120 may be provided in an area other than an area in which the dart target 300 is provided on the front surface of the dart game apparatus 10. Hereinafter, the shape of the dart game apparatus 10 in the present disclosure will be described through FIG. 3.

Figure 3:
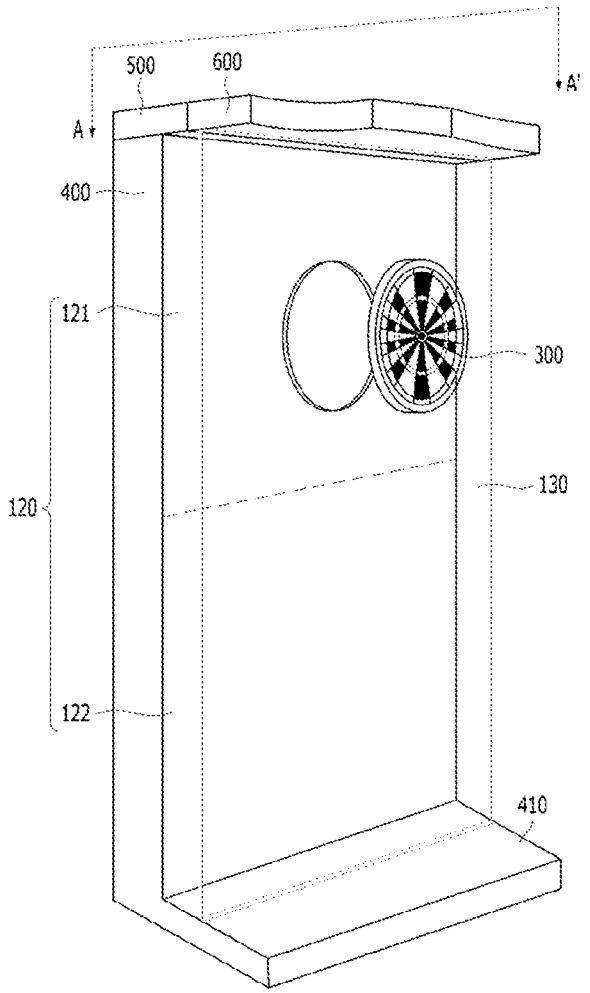
FIG. 3 is a perspective view for describing a dart game apparatus according to some exemplary embodiments of the present disclosure.

FIG. 3 is a perspective view for describing a dart game apparatus according to some exemplary embodiments of the present disclosure.

Referring to FIG. 3, the dart game apparatus 10 may include the display unit 120, the cover unit 130, the dart target 300, the body part 400, the support unit 500, the lid unit 600, and a lower support unit 410. However, components described above are not required in implementing the dart game apparatus 10 and the dart game apparatus 10 may thus have components more or less than components listed above.

In the present disclosure, the display unit 120 may be formed in an area other than an area in which the dart target 300 is provided on the front surface of the dart game apparatus 10. However, although not limited thereto, the display unit 120 may be formed on at least a part of the front surface of the dart game apparatus 10.

The display unit 120 may include a first display area 121 and a second display area 122. However, although not limited thereto, the display unit 120 may include at least one display area.

For example, the display unit 120 may be formed by one display area. As another example, the display unit 120 may also include three or more display areas. Each display area provided in the display unit 120 may be independently controlled by the control unit 110.

For example, different images may be output to the first display area 121 and the second display area 122, respectively. As another example, the first display area 121 and the second display area 122 may also interlock with each other and output a single image or video. However, the present disclosure is not limited thereto.

Meanwhile, according to some exemplary embodiments of the present disclosure, the display unit 120 may include a receiving groove (123 in FIG. 4) capable of receiving the dart target 300. In this case, the dart target 300 may be seated in the receiving groove 123 of the display unit 120. Hereinafter, the receiving groove 123 will be described below in detail through FIGS. 4 and 5.

The cover unit 130 may be provided adjacent to the display unit 120 and protect the display unit 120. For example, the cover unit 130 may be provided spaced apart from the display unit 120 by a predetermined distance. As another example, the cover unit 130 may be provided in contact with the display unit 120. In this case, the cover unit 130 may reduce a damage risk to the display unit 120. Meanwhile, the cover unit 130 may include a hole (131 in FIG. 3) for receiving the dart target 300. Hereinafter, the hole 131 provided in the cover unit 130 will be described below through FIGS. 4 and 5.

The body part 400 may form the external appearance of the dart game apparatus 10 in a rectangular plate form erected from the ground. However, although not limited thereto, the body part 400 may be formed in various forms such as a rectangular pillar shape or a polygonal shape. Further, a space may be provided inside the body part 400. In this case, the control unit 110 may be provided in an internal space of the body part 400. However, the present disclosure is not limited thereto.

The support unit 500 may be provided on an upper side of the body part 400 and serve to connect and support the lid unit 600 to be described subsequently and the body part 400. To this end, the support unit 500 may include a coupling unit (510 in FIG. 6) and an extension unit (520 in FIG. 6). Hereinafter, the support unit 500 will be described below through FIG. 6.

Figure 7:
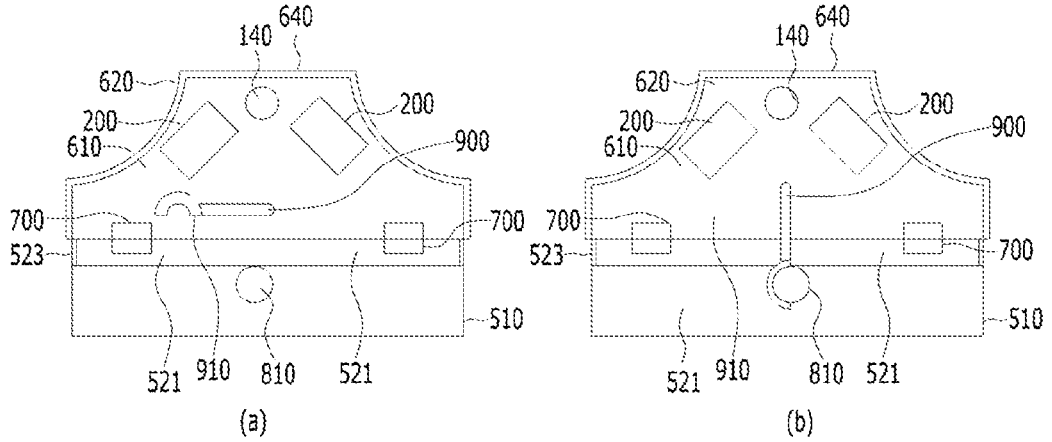
FIG. 7 is a bottom view of a support unit and a lid unit for describing a motion of a latch unit according to some exemplary embodiments of the present disclosure.

The lid unit 600 may be rotatably coupled to the support unit 500 through at least one hinge (700 in FIG. 7).

Specifically, one side of at least one hinge 700 may be coupled to a lower surface of the lid unit 600. The other side of at least one hinge 700 may be provided on the lower surface of the support unit 500. Accordingly, the lid unit 600 may be unfolded so as to be formed in a "¬" shape with the body part 400 when the dart game apparatus 10 is used, and folded when carrying is required. However, the present disclosure is not limited thereto.

Meanwhile, according to some exemplary embodiments of the present disclosure, the lid unit 600 may have a space in which at least one hinge 700 may be provided at a lower portion thereof. Further, the support unit 500 may also have a space in which at least one hinge 700 may be provided corresponding to the shape of the lower surface of the lid unit 600. Hereinafter, a motion in which the lid unit 600 rotates through at least one hinge 700 will be described below through FIGS. 6 to 8.

The lower support unit 410 may be formed to extend in a throw-line direction from an end portion contacting the body part 400 along the ground. Further, the lower support unit 410 may serve to support the body part 400 to be erected from the ground. Meanwhile, according to some exemplary embodiments of the present disclosure, at least one of the camera unit 140, the illumination unit 180, and the sound output unit 190 may be provided even in the lower support unit 410. However, the present disclosure is not limited thereto.

According to the above-described configuration, the dart game apparatus 10 may include the display unit 120 capable of outputting the screen to the front surface of the body part 400.

Meanwhile, according to the above-described configuration, the dart target 300 may be seated on the display unit 120. In this case, the receiving groove 123 needs to be provided in the display unit 120 in order for the dart target to be seated on the display unit 120. Hereinafter, a method in which the dart target 300 is disposed on the front surface of the body part 400 will be described through FIGS. 4 and 5.

Figure 4:
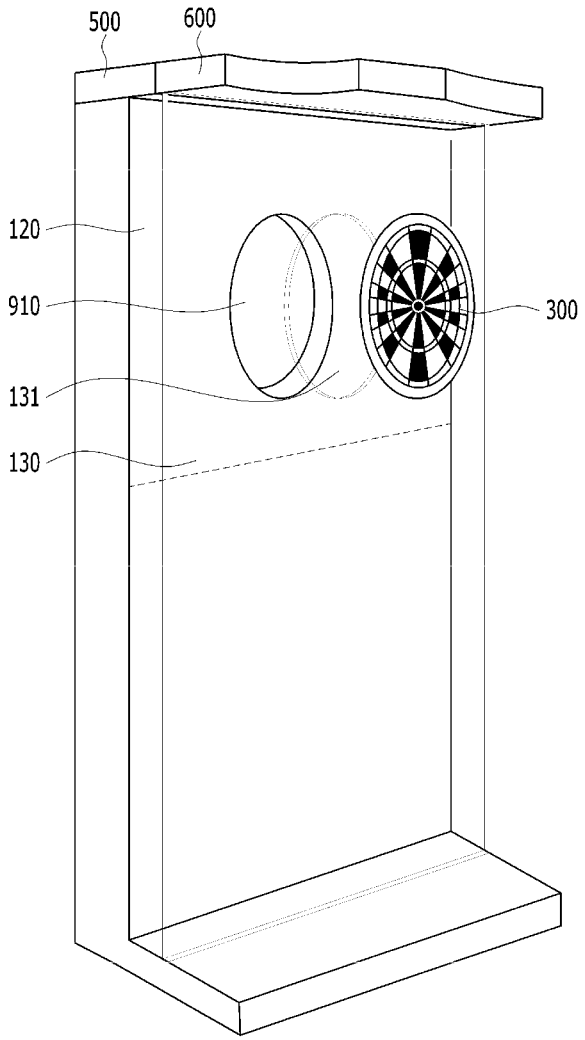
FIG. 4 is a perspective view for describing an example of a method in which a dart target is coupled to a display unit according to some exemplary embodiments of the present disclosure.

FIG. 4 is a perspective view for describing an example of a method in which a dart target is coupled to a display unit according to some exemplary embodiments of the present disclosure.

Referring to FIG. 4, the display unit 120 may include the receiving groove 123 capable of receiving the dart target 300. In this case, the dart target 300 may be seated in the receiving groove 123 of the display unit 120.

The cover unit 130 may include the hole 131. When the dart game player throws the dart pin, the thrown dart pin may pass through the hole 131 of the cover unit 130 and the dart pin passing through the hole 131 may reach the dart target 300 seated on the display unit 120.

Meanwhile, according to some exemplary embodiments of the present disclosure, the receiving groove 123 of the display unit 120 may not be provided. In this case, the dart target 300 may be coupled to the hole 131 provided in the cover unit 130. However, the present disclosure is not limited thereto.

Figure 5:
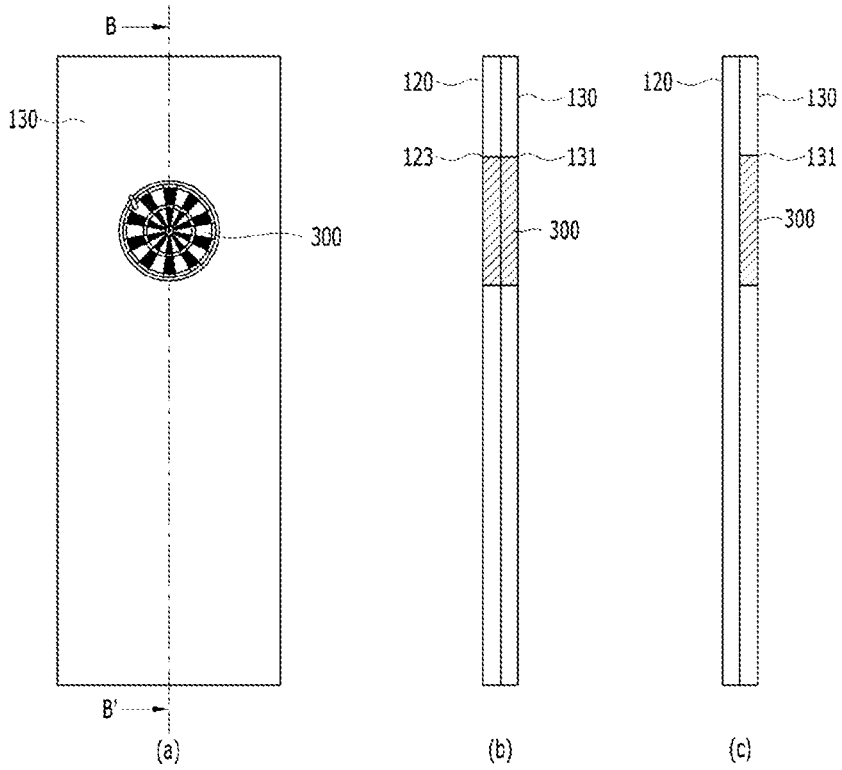
FIG. 5 is a cross-sectional view for describing an example of a method in which a dart target is coupled to at least one of a display unit or a cover unit according to some exemplary embodiments of the present disclosure.

FIG. 5 is a cross-sectional view for describing an example of a method in which a dart target is coupled to at least one of a display unit or a cover unit according to some exemplary embodiments of the present disclosure.

Referring to FIG. 5A, the dart target 300 may be seated on at least of the display unit 120 or the cover unit 130.

Meanwhile, FIGS. 5B and 5C are diagrams illustrating a cross-sectional view of B-B' of FIG. 5A.

Specifically, referring to FIG. 5B, the receiving groove 123 may be provided in the display unit 120. In this case, the dart target 300 may be seated in the receiving groove 123 provided in the display unit 120.

In this case, in the cover unit 130, the hole 131 through which the dart pin may pass may be generated to correspond to the size of the dart target 300. Accordingly, the dart pin thrown by the player may reach the dart target 300 by passing through the hole 131 provided in the cover unit 130.

Meanwhile, referring to FIG. 5C, the receiving groove 123 may not be provided in the display unit 120.

In this case, an outer edge of the dart target 300 may be coupled to the hole 131 provided in the cover unit 130 and a rear surface may be seated in the front surface of the display unit 120. However, the present disclosure is not limited thereto.

According to the above-described configuration, the dart game apparatus 10 may simultaneously include the display unit 120 and the dart target 300 provided on the front surface of the body part 400.

Meanwhile, according to some exemplary embodiments of the present disclosure, when the dart game apparatus 10 needs to be transported, the lid unit 600 provided on an upper end of the dart game apparatus 10 may be folded in order to reduce the volume. Hereinafter, this will be described through FIGS. 6 to 8.

FIG. 6 is a diagram illustrating a cross-sectional view of A-A' of FIG. 3 in order to describe a support unit and a lid unit in a dart game apparatus according to some exemplary embodiments of the present disclosure.

Referring to FIG. 6, the dart game apparatus 10 may include the body part 300, the support unit 500, the lid unit 600, at least one fixation unit 800, and at least one latch unit 900. However, components described above are not required in implementing the dart game apparatus 10 and the dart game apparatus 10 may thus have components more or less than components listed above.

The body part 400 may form the external appearance of the dart game apparatus 10. In addition, the body part 400 may include components of the dart game apparatus 10 therein. Meanwhile, the display unit 120 may be installed in the first area of the front surface of the body part 400.

Meanwhile, an upper structure may be coupled to the upper side of the body part 400. The upper structure may include the support unit 500 and the lid unit 600. Here, the upper structure is coupled to the upper side of the body part 400 to block light incident toward the front surface of the body part 400 from an upper portion of the body part 400. When the dart game apparatus 10 has such a structure, immersion in the dart game of the dart game user may be enhanced.

The support unit 500 may be provided on the upper side of the body part 400. In addition, the lid unit 600 may be rotatably coupled to the support unit 500 through at least one hinge. The upper structure has the support unit 500 to sufficiently provide support force required for forming the lid unit 600.

Meanwhile, the support unit 500 may include the coupling unit 510 and the extension unit 520. However, the present disclosure is not limited thereto.

The coupling unit 510 may be formed in a shape corresponding to the upper surface of the body part 400. In addition, the coupling unit 510 may be coupled to the upper surface of the body part 400.

For example, when the upper surface of the body part 400 has a rectangular shape, the coupling unit 510 may be formed in the rectangular shape and coupled to the upper surface of the body part 400. However, the present disclosure is not limited thereto.

In the present disclosure, the first area of the front surface of the body part 400 may be provided as the display unit 120. Accordingly, the coupling unit 510 needs to be coupled to the upper surface of the body part 400 by avoiding the display unit 120.

The coupling unit 510 is coupled to the upper surface of the body part 400 to provide sufficient support force even though the extension unit 520 to be described below is formed to protrude from the body part 400. However, the present disclosure is not limited thereto.

The extension unit 520 may be formed to extend toward the front surface of the coupling unit 510. Further, the extension unit 520 may be formed integrally with the coupling unit 510. However, although not limited thereto, the extension unit 520 may also be formed as a separation type. That is, the extension unit 520 may mean a part which protrudes from the body part 400 by a predetermined distance in the coupling unit 510.

Meanwhile, as the extension unit 520 is formed to protrude from the body part 400 by a predetermined distance, a space in which the lid unit 600 may be folded may be generated. Further, a length of the extension unit 520 which is formed to extend from the coupling unit 510 may be formed to be larger than a thickness of the lid unit 600.

Specifically, a third length which is a length of the extension unit 520 formed to extend from the coupling unit 510 may be equal to or larger than a fourth length which is a length of the lid unit 600 from one upper end to the other lower end. In this case, the lid unit 600 may be prevented from contacting at least a part of the display unit 120 until at least a part of the lid unit 600 is fully folded. Accordingly, the lid unit 600 may be folded to be in parallel to the body part 400. That is, at least one hinge which rotatably couples the support unit 500 and the lid unit 600 may be bent in the "¬" shape. However, the present disclosure is not limited thereto.

The extension unit 520 may include a first upper surface portion 521, a first lateral surface portion 522, and a second lateral surface portion (not illustrated). However, the present disclosure is not limited thereto.

The first upper surface portion 521 may form the upper surface of the extension unit 520.

One side of at least one hinge (700 in FIG. 7) may be coupled to the lower surface of the first upper surface portion 521. For example, at least one hinge may be coupled to the lower surface of the first upper surface portion 521 through a screw, etc. However, the present disclosure is not limited thereto.

The first lateral surface portion 522 and the second lateral surface portion may be formed to extend toward the lower portion from both lateral surfaces of the first upper surface portion 521. In this case, a first space 523 surrounded by the first upper surface portion 521, the first lateral surface portion 522, and the second lateral surface portion may be formed at the lower portion of the first upper surface portion 521.

As described above, when the extension unit 520 is manufactured in a shape having the first space 523 other than a shape in which the lower portion of the extension unit 520 is clogged, at least one hinge may be coupled to an inner side of the extension unit 520. In this case, since at least one hinge is coupled to a space not viewed by the user, the upper surface of the dart game apparatus 10 which may be exposed to at least one user may be formed smooth.

Meanwhile, the lid unit 600 may be rotatably coupled to the extension unit 520 of the support unit 500 through at least one hinge. When the lid unit 600 is rotatably coupled to the support unit 500, the volume of the dart game apparatus 10 may be reduced upon transporting the dart game apparatus 10.

The lid unit 600 may include a second upper surface portion 610, a third lateral surface portion 620, a fourth lateral surface portion (not illustrated), a second space 630, and a front surface portion 640. However, the present disclosure is not limited thereto.

The second upper surface portion 610 may form the upper surface of the lid unit 600.

The other side of one side of at least one hinge (700 in FIG. 7) coupled to the extension unit 520 may be coupled to the lower surface of the second upper surface portion 610. For example, at least one hinge may be coupled to the lower surface of the first upper surface portion 521 through a screw, etc. However, the present disclosure is not limited thereto.

The third lateral surface portion 620 and the fourth lateral surface portion may be formed to extend toward the lower portion from both lateral surfaces of the second upper surface portion 610. In this case, the second space 630 surrounded by the second upper surface portion 610, the third lateral surface portion 620, and the fourth lateral surface portion may be formed at the lower portion of the second upper surface portion 610.

As described above, when the lid unit 600 is manufactured in a shape having the second space 630 other than a shape in which the lower portion of the lid unit 600 is clogged, at least one hinge may be coupled to the inner side of the lid unit 600. In this case, since at least one hinge is coupled to a space not viewed by the user, the upper surface of the dart game apparatus 10 which may be exposed to the user may be formed smooth. However, the present disclosure is not limited thereto.

Meanwhile, as in the present disclosure, the first space 523 and the second space 630 are not provided in the dart game apparatus 10, but at least one hinge may also be provided on the lower surfaces of the extension unit 520 and the lid unit 600. When the lid unit 600 is folded in such a structure, a surface where the extension unit 520 and the lid unit 600 contact may be exposed to the outside if the lid unit 600 is unfolded. Accordingly, at least two corners may be formed in an upper external appearance of the dart game apparatus 10. The corner is a portion on which stress is primarily concentrated when an impact is generated externally, and when the number of corners increases, the damage risk to the dart game apparatus 10 may increase.

Accordingly, like the structure of the dart game apparatus 10 according to the present disclosure, it is preferable that the first space 523 and the second space 630 are provided, and at least one hinge is coupled to the lower surface of each of the first upper surface portion 521 and the second upper surface portion 610.

The front surface portion 640 may be formed to extend toward the lower portion on the front surface of the second upper surface portion 610. In this case, the front surface portion 640 may hide components provided at the lower portion of the second upper surface portion 610. As an example, at least one camera or at least one illumination unit arranged to face at least one user may also be provided on the front surface of the front surface portion 640. However, the present disclosure is not limited thereto.

Meanwhile, according to some exemplary embodiments of the present disclosure, a first length which is a length between the first lateral surface portion 522 and the second lateral surface portion may be equal to or smaller than a second length which is a length between the third lateral surface portion 620 and the fourth lateral surface portion. That is, a horizontal length of the first upper surface portion 521 may be larger than the horizontal length of the second upper surface portion 610. In this case, while at least one hinge 700 is folded, at least parts of the first lateral surface portion 522 and the second lateral surface portion may be inserted into the second space 630. Hereinafter, while at least one hinge 700 is folded, a shape in which at least a part of the extension unit 520 is inserted into the second space 630 of the lid unit 600 will be described below through FIG. 8.

Meanwhile, according to some exemplary embodiments of the present disclosure, the camera unit 140 disposed toward the front surface of the body part 400 may be provided on the lower surface of the second upper surface portion 610 while at least one hinge 700 is unfolded.

The camera unit 140 may photograph at least one image related to the dart target 300. Further, at least one image photographed by the camera unit 140 may be stored in the memory or displayed on the display unit 120 under the control by the control unit 110. However, the present disclosure is not limited thereto.

Meanwhile, according to some exemplary embodiments of the present disclosure, the target illumination unit 200 irradiating light toward the front surface of the body part 400 may be provided on the lower surface of the lid unit 600 while at least one hinge 700 is unfolded.

Specifically, the target illumination unit 200 may be provided at a predetermined angle with the second upper surface portion 610 so as to irradiate the light toward the front surface of the body part 400.

For example, the target illumination unit 200 may be provided in the second upper surface portion 610 at an angle of 45 degrees. However, although not limited thereto, the target illumination unit 200 may also be provided so that a motion such as rotation is enabled under the control by the control unit 110.

Meanwhile, the target illumination unit 200 may also output the signal for announcing the occurrence of the event of the dart game apparatus 10.

For example, the target illumination unit 200 may include the LED to irradiate the light toward the front surface of the body part 400 through flicking of the LED. Additionally, the target illumination unit 200 may vary and output the type of light emission, the intensity of light emission, and/or the flicker cycle depending on the location at which the dart pin reaches the dart target 300.

Meanwhile, at least one fixation unit 800 may be provided on the lower surface of the extension unit 520.

Specifically, at least one fixation unit 800 may be fixed and coupled to the lower surface of the first upper surface portion 521. In this case, at least one fixation unit 800 may allow at least one latch unit 900 to be described below to be fixed.

For example, when at least one latch unit 900 is fastened to at lest one fixation unit 800, at least one latch unit 900 may be fixed.

Meanwhile, at least one latch unit 900 may be rotatably provided on the lower surface of the lid unit 600, and may have a seating groove 910 into which at least one fixation unit 800 is inserted. As an example, the seating groove 910 may have a semi-circular shape in order to insert at least one fixation unit 800. As another example, the seating groove 910 may have a "C" shape in order to insert at least one fixation unit 800. In this case, at least one latch unit 900 may maintain a state in which at least one latch unit 900 is fixed to at least one fixation unit 800 through the seating groove 910.

Meanwhile, at least one latch unit 900 is rotatably coupled to one area of the second upper surface portion 610, and may be folded to be in parallel to the front surface of the body part 400 or unfolded to be vertical to the front surface of the body part 400. When at least one latch unit 900 is unfolded, the seating groove 910 provided in at least one latch unit 900 may be coupled to at least one fixation unit 800.

Specifically, when at least one fixation unit 800 is inserted into the seating groove 910 provided in at least one latch unit 900 while at least one hinge is unfolded, at least one hinge may maintain a state in which at least one hinge is unfolded.

More specifically, when at least one fixation unit 800 is inserted into the seating groove 910 provided in at least one latch unit 900, one side in which at least one latch unit 900 is rotatably coupled to the second upper surface portion 610 may be positioned on the lower surface of the second upper surface portion 610. In this case, the other side with the seating groove 910 of at least one latch unit 900 may be positioned on the lower surface of the first upper surface portion 521. In such a structure, at least one latch unit 900 may support the lid unit 600 not to sag due to gravity. That is, at least one latch unit 900 may maintain a state in which at least one hinge is unfolded. Accordingly, a state in which the lid unit 600 is unfolded through at least one latch unit 900 may be maintained. However, the present disclosure is not limited thereto.

Meanwhile, according to some exemplary embodiments of the present disclosure, at least one fixation unit 800 may include a first member 810 and a second member 820.

Specifically, referring to a detailed diagram of FIG. 6, each of at least one fixation unit 800 may include the first member 810 in order to prevent at least one latch unit 900 from sagging when at least one latch unit 900 is coupled. In addition, each of at least one fixation unit 800 may include the second member 820 into which the seating groove 910 of at least one latch unit 900 is inserted.

Meanwhile, the first member 810 may have a second diameter larger than a first diameter of an inner diameter of the seating groove 910. In such a structure, at least one first member 810 may prevent the seating groove 910 from sagging below the first member 810.

The second member 820 may be provided between at least one first member 810 and the lower surface of the second upper surface portion 610 included in the lid unit 600, and inserted into the seating groove 910.

Accordingly, in the state in which at least one hinge 700 is unfolded, at least one latch unit 900 may be coupled to at least one fixation unit 800 through the provided seating groove 910. In this case, the state in which at least one hinge 700 is unfolded may be maintained. That is, at least one latch unit 900 may prevent the lid unit 600 from sagging due to the gravity in the state in which at least one hinge 700 is unfolded.

Meanwhile, according to some exemplary embodiments of the present disclosure, a thickness of at least one latch unit 900 may be equal to or smaller than a length between the lower surface of the second upper surface portion 610 of the lid unit 600 and the first member 810. In this case, at least one latch unit 900 may be fitted between the first member 810 and the second upper surface portion 610.

According to the above-described configuration, the lid unit 600 of the dart game apparatus 10 may be folded or unfolded according to a situation.

Hereinafter, a method in which the latch unit 900 capable of fixing the lid unit 600 rotates when the lid unit 600 is unfolded in the present disclosure will be described in more detail through FIG. 7.

FIG. 7 is a bottom view of a support unit and a lid unit for describing a motion of a latch unit according to some exemplary embodiments of the present disclosure. The contents disclosed in FIG. 6 are referred to for a feature duplicated with the feature described above in relation to FIG. 6 among the features for the contents illustrated in FIG. 7 and here, a description thereof will be omitted.

Referring to FIG. 7, one side of at least one hinge 700 may be coupled to the lower surface of the first upper surface portion 521. In addition, the other side of at least one hinge 700 may be coupled to the lower surface of the second upper surface portion 610. In this case, at least one hinge 700 may be folded in the "⊓" shape or may be unfolded in a "—" shape. Accordingly, the lid unit 600 may be folded or unfolded through pivoting of at least one hinge 700.

Meanwhile, according to some exemplary embodiments of the present disclosure, a first length which is a length between the first lateral surface portion 522 and the second lateral surface portion may be equal to or smaller than a second length which is a length between the third lateral surface portion 620 and the fourth lateral surface portion. That is, a horizontal length of the first upper surface portion 521 may be larger than the horizontal length of the second upper surface portion 610. In this case, while at least one hinge 700 is folded, at least parts of the first lateral surface portion 522 and the second lateral surface portion may be inserted into the second space. Accordingly, when the lid unit 600 is folded, interference may be removed and folded, which may occur with the extension unit 520 of the support unit 500.

Meanwhile, according to some exemplary embodiments of the present disclosure, when the lid unit 600 is folded, at least one latch unit 900 may be positioned at the lower portion of the lid unit 600.

Specifically, referring to FIG. 7A, at least one latch unit 900 may rotate to be stored in the second space 330 when the lid unit 600 is folded. In this case, when the lid unit 600 is folded, interference may be removed, which may occur by at least one latch unit 900.

Meanwhile, as in FIG. 7B, when the lid unit 600 is unfolded, at least one latch unit 900 may rotate to be coupled to the first member 810 of at least one fixation unit 800.

Meanwhile, according to some exemplary embodiments of the present disclosure, at least one target illumination unit 200 may be disposed to irradiate light toward the front surface of the body part 400.

Specifically, the target illumination unit 200 may be disposed toward the dart target 300 provided on the front surface of the body part 400. In this case, the target illumination unit 200 may concentratively irradiate the light toward the dart target 300 under the control by the control unit 110. However, the present disclosure is not limited thereto.

Meanwhile, according to some exemplary embodiments of the present disclosure, a lid unit cover (not illustrated) having a shape corresponding to the shape of the lid unit 600 may be coupled to the lower side of the lid unit 600.

The lid unit cover may not be coupled to the lid unit 600 upon transporting the dart game apparatus 10. In addition, the dart game apparatus 10 may be installed in the lid unit cover, and when the lid unit 600 is unfolded, the lid unit cover may be coupled to cover the lower surface of the lid unit 600. However, the present disclosure is not limited thereto.

Meanwhile, at least one opening portion may be provided on the lower surface of the lid unit cover. In this case, the camera unit 140 and the target illumination unit 200 provided on the lower surface of the second upper surface portion 610 may photograph the front surface of the body part 400 or irradiate the light to the front surface of the body part 400 through at least one opening portion. However, the present disclosure is not limited thereto.

Figure 8:
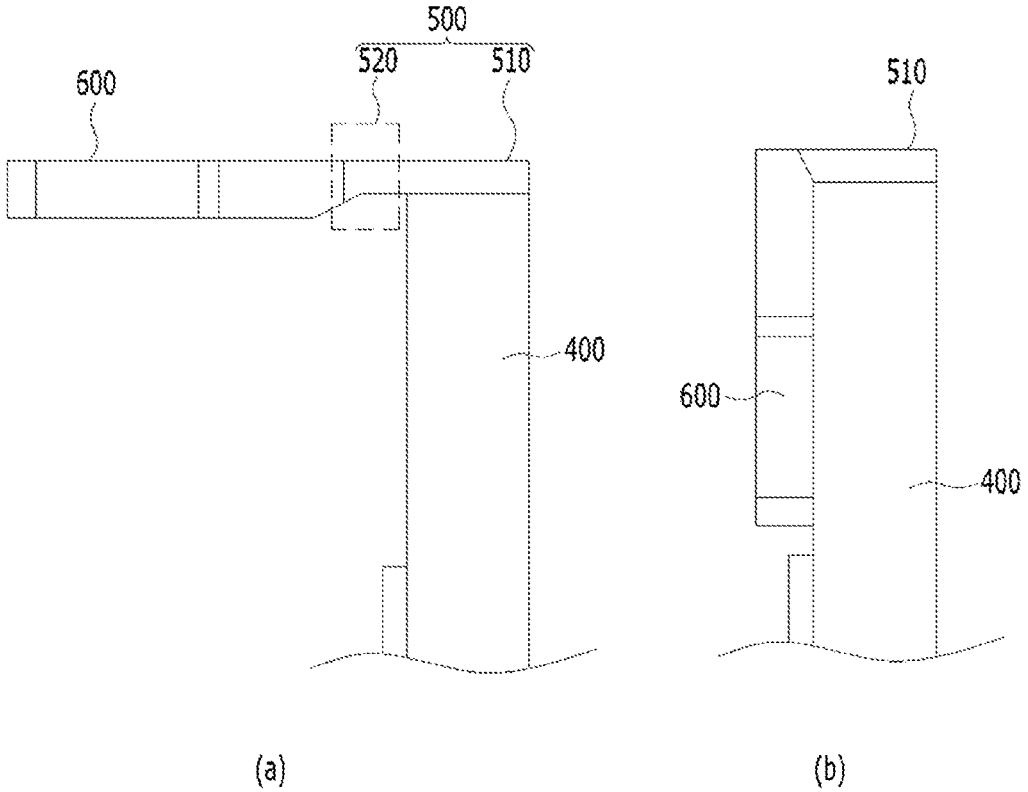
FIG. 8 is a diagram for describing an example of a method in which a lid unit is folded according to some exemplary embodiments of the present disclosure.

FIG. 8 is a diagram for describing an example of a method in which a lid unit is folded according to some exemplary embodiments of the present disclosure.

Referring to FIG. 8A, in the dart game apparatus 10, the lid unit 600 may be unfolded at normal times (for example, transporting or loading is not required).

In this case, the dart game apparatus 10 may provide the dart game so that at least one user plays the dart game.

In the dart game apparatus 10, when the lid unit 600 is unfolded, an angle at which the camera unit 140 provided on the lower surface of the lid unit 600 may photograph the front surface of the body part 400 may be generated.

Meanwhile, in the state in which the lid unit 600 of the dart game apparatus 10 is unfolded, the extension unit 520 may be viewed externally. However, in the state in which the lid unit 600 of the dart game apparatus 10 is folded, at least a part of the extension unit 520 may be inserted into the second space 630 provided in the lid unit 600 and not viewed.

Specifically, referring to FIG. 8B, when transporting the dart game apparatus 10 is required, the lid unit 600 may be folded. In this case, as described above, at least one hinge 700 may be provided in the second upper surface portion 610 of the lid unit 600 and the first upper surface portion 521 of the extension unit 520. Further, since a width of the extension unit 520 is smaller than the width of the lid unit 600, at least a part of the extension unit 520 may be inserted into the lid unit 600.

Accordingly, the lid unit 600 may be folded to be in parallel to the front surface of the body part 400. When even any one among the above-described components is insufficient, the lid unit 600 may not be in parallel to the front surface of the body part 400 and may be less folded. In this case, the upper side of the dart game apparatus 10 or the display unit 120 may be easily damaged.

As described above, the dart game apparatus 10 in the present disclosure may have various components for provoking the interest of the user.

For example, in the dart game apparatus 10, the control unit 110 may receive the image related to the dart target 300 from the camera unit 140 provided in the lid unit 600 which is formed to protrude from the body part 400 and display the image on the display unit 120. As another example, the control unit 110 of the dart game apparatus 10 may also control a preset event to be irradiated to the dart target 300 through the target illumination unit 200 provided in the lid unit 600 which is formed to protrude from the body part 400.

The dart game apparatus 10 may have the lid unit 600 having a structure which protrudes from the body part 400 in order to include the above-described components and other components, and jointly have a configuration capable of reducing the volume when necessary.

The description of the presented exemplary embodiments is provided so that those skilled in the art of the present disclosure use or implement the present disclosure. Various modifications of the exemplary embodiments will be apparent to those skilled in the art and general principles defined herein can be applied to other exemplary embodiments without departing from the scope of the present disclosure. Therefore, the present disclosure is not limited to the exemplary embodiments presented herein, but should be interpreted within the widest range which is coherent with the principles and new features presented herein.

What is claimed is:

1. A dart game apparatus comprising:

a body part in which a dart target is installed on a front surface;

a support unit including a coupling unit coupled to an upper side of the body part and an extension unit formed to extend toward a front surface of the coupling unit; and a lid unit rotatably coupled to the support unit through at least one hinge, wherein the support unit further includes:

at least one fixation unit provided on a lower surface of the extension unit, and the lid unit includes at least one latch unit rotatably provided on a lower surface of the lid unit and having a seating groove into which the at least one fixation unit is inserted.

2. The dart game apparatus of claim 1, further comprising:

a camera unit provided in the lid unit and disposed toward the front surface of the body part in a state in which at the least one hinge is unfolded; and a target illumination unit provided in the lid unit and irradiating light toward the front surface of the body part in a state in which the at least one hinge is unfolded.

3. The dart game apparatus of claim 1, wherein when the at least one fixation unit is inserted into the seating groove provided in the at least one latch unit in a state in which the at least one hinge is unfolded, the at least one hinge maintains the unfolded state.

4. The dart game apparatus of claim 1, wherein the at least one fixation unit includes a first member having a second diameter larger than a first diameter of an inner diameter of the seating groove, and a second member provided between the first member and the lower surface of the lid unit, and inserted into the seating groove.

5. The dart game apparatus of claim 4, wherein a thickness of the at least one latch unit is equal to or smaller than a length between the lower surface of the lid unit and the first member.

6. A dart game apparatus comprising:

a body part in which a dart target is installed on a front surface;

a support unit including a coupling unit coupled to an upper side of the body part and an extension unit formed to extend toward a front surface of the coupling unit; and a lid unit rotatably coupled to the support unit through at least one hinge;

wherein the extension unit further includes:

a first upper surface portion, and a first lateral surface portion and a second lateral surface portion formed to extend toward a lower portion from both lateral surfaces of the first upper surface portion so that a first space is formed at a lower portion of the first upper surface portion, and the lid unit includes a second upper surface portion, a third lateral surface portion and a fourth lateral surface portion formed to extend toward a lower portion from both lateral surfaces of the second upper surface portion so that a second space is formed at a lower portion of the second upper surface portion, and a front surface portion formed to extend toward the lower portion on the front surface of the second upper surface portion.

7. The dart game apparatus of claim 6, wherein in the at least one hinge, one side is coupled to a lower surface of the first upper surface portion and other side is coupled to a lower surface of the second upper surface portion.

8. The dart game apparatus of claim 6, wherein a first length which is a length between the first lateral surface portion and the second lateral surface portion is equal to or less than a second length which is a length between the third lateral surface portion and the fourth lateral surface portion.

9. The dart game apparatus of claim 8, wherein a third length of the extension unit which is a length formed to extend from the coupling unit is equal to or longer than a fourth length which is a length from one upper end to other lower end of the lid unit.

10. The dart game apparatus of claim 6, wherein in a state in which the at least one hinge is folded, at least parts of the first lateral surface portion and the second lateral surface portion are inserted into the second space.

* * * * *